US005313931A

United States Patent [19]

Coulcher, Jr. et al.

[11] Patent Number: 5,313,931

[45] Date of Patent: May 24, 1994

[54] ONE HAND FIXED TEMPERATURE COATING REMOVER

[75] Inventors: Richard D. Coulcher, Jr., Rochester; Alan A. Hyde, Byron; Michael L. Ridley, Holley, all of N.Y.

[73] Assignee: Newell Operating Company, Freeport, Ill.

[21] Appl. No.: 795,405

[22] Filed: Nov. 20, 1991

[51] Int. Cl.[5] ..... B26B 27/00

[52] U.S. Cl. ..... 126/401; 126/406; 126/271.1; 431/255; 431/256; 431/266; 431/343; 431/345; 30/140; 30/169

[58] Field of Search ..... 431/264, 265, 266, 255, 431/343, 354, 355, 344, 256, 345; 126/401, 402, 403, 404, 405, 410, 411, 406, 407, 271.1; 30/140, 169; 134/38

[56] References Cited

U.S. PATENT DOCUMENTS

| | | | |
|---|---|---|---|
| 169,439 | 11/1875 | Hayes . | |
| D. 204,914 | 5/1966 | Kersten . | |
| D. 279,814 | 7/1985 | Gaines . | |
| D. 283,975 | 5/1986 | Anderson . | |
| D. 305,818 | 1/1990 | Chan . | |
| 427,759 | 5/1890 | Gillis . | |
| 651,709 | 6/1900 | Foulger et al. . | |
| 887,743 | 5/1908 | Storm, Jr. . | |
| 1,074,755 | 10/1913 | Spira . | |
| 1,187,821 | 6/1916 | Dempster et al. . | |
| 1,408,623 | 3/1922 | Manley . | |
| 2,133,922 | 10/1938 | Laskin | 126/401 |
| 2,140,478 | 12/1938 | Mossback | 30/140 |
| 2,220,738 | 11/1940 | Stoddard . | |
| 2,258,627 | 10/1941 | Mossback et al. | 30/140 |
| 2,326,630 | 8/1943 | Fagan . | |
| 2,627,905 | 2/1953 | Mangieri . | |
| 2,629,433 | 2/1953 | Scholl . | |
| 2,666,480 | 1/1954 | Peterson | 431/344 X |
| 2,698,653 | 1/1955 | Hollaway . | |
| 2,995,159 | 8/1961 | Berggren . | |
| 3,029,807 | 4/1962 | Webster . | |
| 3,079,980 | 3/1963 | Mihm . | |
| 3,171,466 | 3/1965 | Katchur, Jr. . | |
| 3,673,383 | 6/1972 | Sofia . | |
| 3,759,245 | 9/1973 | Greco, Sr. . | |
| 3,811,160 | 5/1974 | MacDonald . | |
| 3,845,755 | 11/1974 | Aske | 126/401 |
| 4,526,532 | 7/1985 | Nelson . | |
| 4,666,399 | 5/1987 | Nelson | 431/344 X |
| 4,781,482 | 11/1988 | Ursprung . | |
| 4,920,951 | 5/1990 | Le Marchand et al. . | |
| 4,995,171 | 2/1991 | Yoshinaga et al. . | |
| 5,009,592 | 4/1991 | Roldan et al. . | |

FOREIGN PATENT DOCUMENTS

| | | | |
|---|---|---|---|
| 0071896 | 3/1947 | Norway | 15/236.01 |

OTHER PUBLICATIONS

WO89/10850, Nov. 16, 1989, Ashdown.

*Primary Examiner*—Carl D. Price
*Attorney, Agent, or Firm*—Baker & McKenzie

[57] ABSTRACT

A one hand coating stripping device and a method of stripping coating in which operator required control of the angle of flame impingement, flame intensity, speed of movement and removal of stripped material is reduced to the single operator mandated parameter of control of speed of movement of a stripping device which automatically orients the center line of the flame at the most effective angle of impingement and the scraper blade at the optimum angle of attack following a single adjustment of a gas-air mixture compatible with the fixed and constant angles of impingement and attack, the stripping action being carried out by the use of only one hand of an operator.

4 Claims, 2 Drawing Sheets

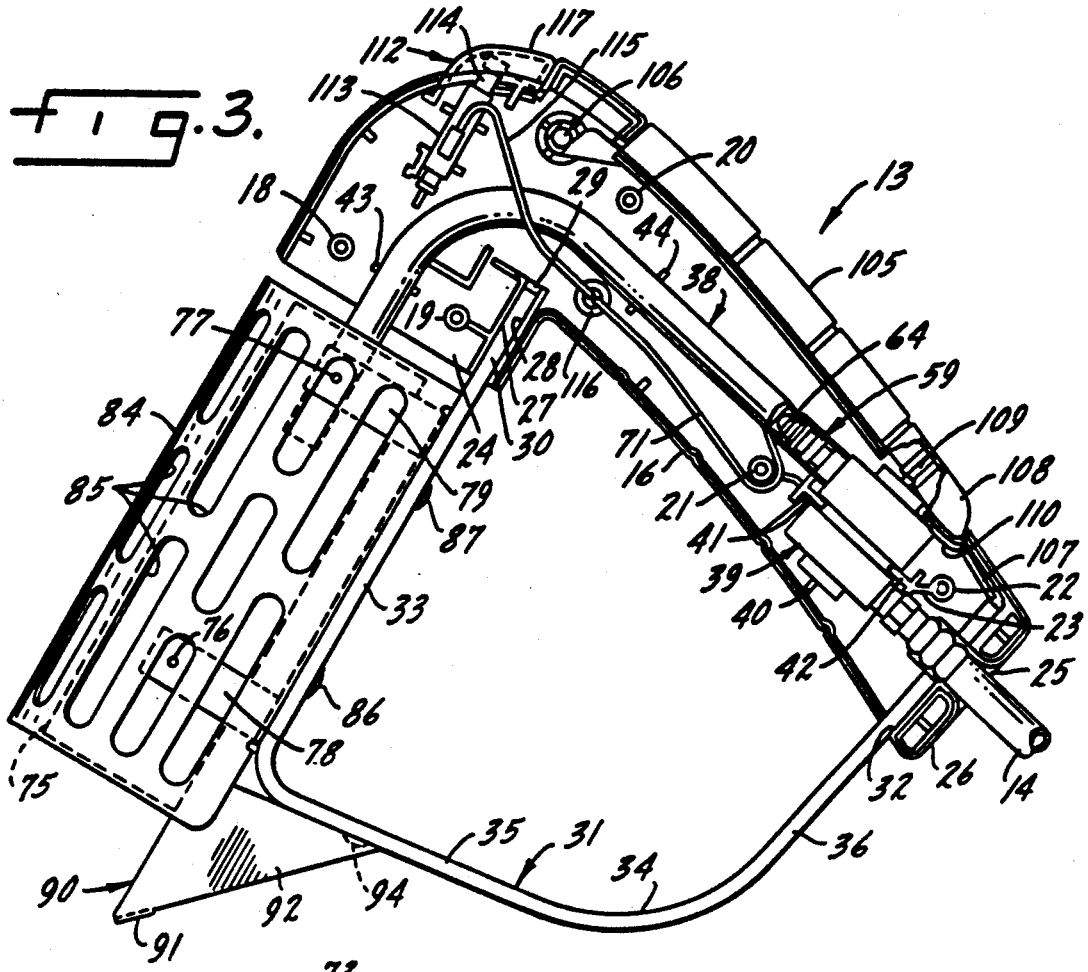
fig.3.
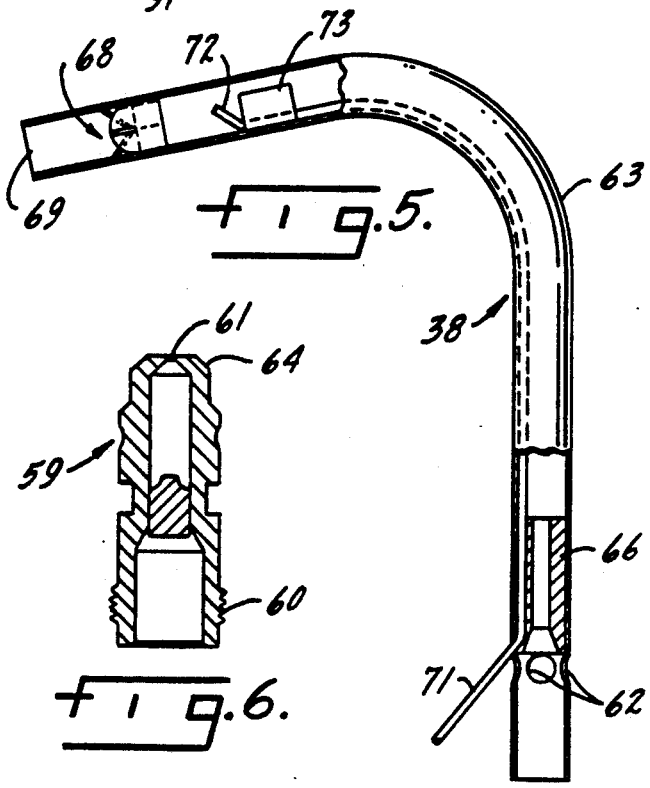
fig.5.
fig.6.
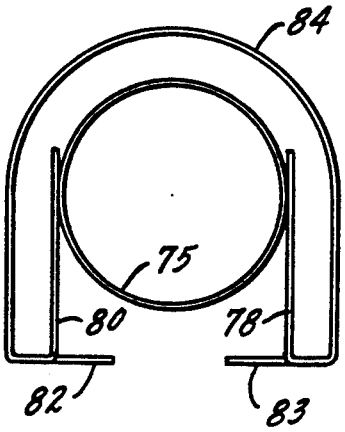
fig.7.

ONE HAND FIXED TEMPERATURE COATING REMOVER

SUMMARY OF THE INVENTION

This invention relates generally to an apparatus and method for removing or stripping coatings from surfaces by heat, and specifically to a stripping device which always presents the angle of impingement of the flame to the coated surface at the optimum angle for maximum coating removal, yet which requires only one hand operation.

BACKGROUND OF THE INVENTION

Coating removing devices which utilize heat to soften a coating prior to removal by a scraper are well known in the art. Such devices, which are commonly called paint strippers, nearly always have one or more of the following drawbacks.

Some paint strippers are, in effect, only a heat gun whose sole function is to soften a coat of paint preparatory to stripping. One example of such a system is shown in U.S. Pat. No. 3,029,807. The stripping is thereafter done by another separate implement, such as a putty knife or possibly even a special scraper. Since the paint must be first softened and thereafter stripped, the speed of stripping is slowed because the heating or softening of the paint and the scraping of the paint are separate, sequential operations. Further, if the user misjudged the looseness of the coating following a heating pass to such an extent that an area must be reheated and then scrapped a second time, which can happen either from poorly controlled hand pressure by the operator or an attempt to heat too long a strip before scraping, the time to clean a given surface area is even further lengthened over a properly executed one-pass action.

Other paint stripping devices combine a paint scraping device with the heat gun in one implement. Examples of this type of stripping device are shown in U.S. Pat. No. 3,759,245, although there are others, such as U.S. Pat. Nos. 3,845,755 and 3,079,980. While theoretically this general type of stripper would appear to shorten the time required by the heat-then-strip sequence of the earlier described devices, in fact they do not. Among the drawbacks of such combined function devices are the following.

Frequently there is no means of maximizing the heat softening step which, of course, is essential to maximum speed operation. Specifically, the experienced user knows that there is an optimum angle of impingement of the paint softening flame against the surface to be stripped, and an optimum flame intensity for best results, though these two factors are related to some extent and, of course, are also related to the speed of movement of the device. Further, there is often the problem of effective removal of the stripped paint in the sense that the stripped paint may not have a separating force applied to its under surface at precisely the right angle of attack and, once it has been separated from its carrying surface, must be quickly and efficiently removed from the working area in order not to clog the device and interrupt operation. In fact, all factors mentioned above are interrelated; the angle of attack of the flame, the flame intensity, the speed of movement of the stripping device across the coated surface, the proper angle of attack of the scraper blade and the removal of just-stripped paint are dependent on one another in the sense that variation of one factor will require variation of one or more additional factors. Thus, in this second general type of paint stripping devices the operator must monitor four or five independent and variable operating parameters to achieve optimum, or near optimum, results. This is exceedingly difficult to do, even for an experienced operator, over substantial periods of time, and it is daunting and, frequently, frustrating, to the average consumer who does not strip paint as part of the practice of a trade, but who needs to do such a task only from time to time on an irregular time schedule in a home environment.

And further it should be noted that stripping paint from a surface other than a horizontally disposed surface increases the difficulty of stripping. This is particularly true as the device approaches and operates on areas that are near the end of the operator's reach, such as are encountered when an operator, standing on a floor, attempts to strip the upper end of a window frame and, even more difficult, an overhead surface such as the underside of the upper end of a window frame.

BRIEF DESCRIPTION OF THE INVENTION

The combined heating and scraping paint stripping device of this invention, though inherently dependant on the four variable operational factors of angle of flame impingement, flame intensity, angle of scraper attack, speed of movement and continuous removal of stripped paint eliminates the need to individually control, simultaneously, these factors and permits the operator to concentrate only on maintaining optimum speed of movement for the other operational factors, said factors being by virtue of the design of the equipment and its mode of operation, fixed.

Specifically, the heating and stripping device of this invention includes a scraper blade which is always oriented at the most efficient angle of attack against the coating on the painted surface by a rigid frame which, together with the scraper blade, forms a two point support for the device which thereby fixes the angle of attack. A flame generating assembly is arranged just in front of the scraper and the optimum flame impingement angle is thereby always present. The scraper blade has an extremely efficient open pass-through passage which permits just softened and lifted paint to be continuously discharged from the device. In addition, the removal of continuous operator monitoring of the angle of attack of the scraper blade and the consequent fixed distance between the point of flame generation and flame impingement permits an easily adjustable fuel regulator to provide the exact quantity of fuel required for a given speed of operation.

As a consequence, once the operator settles into a comfortable, easily maintained constant or near constant speed of operation, which is well within the ability of an initially unskilled operator such as a consumer who does an occasional paint removal project, the operator can operate the device without regard to flame impingement angle, flame intensity, scraper blade attack angle, or discharge of stripped paint, thereby performing the required work at maximum efficiency.

Further, and importantly, the stripping device requires only one hand to operate and hence all of the above is accomplished by the use of only one hand.

BRIEF DESCRIPTION OF THE INVENTION

The invention is illustrated more or less diagrammatically in the accompanying drawing wherein:

FIG. 3 is a side elevation with the left half cover removed for clarity of the stripping device of this invention and with other parts broken away;

FIG. 5 is a side view to an enlarged scale of the burn tube assembly of FIG. 3 with parts in section and others broken away for clarity;

FIG. 6 is a section through the orifice of the fuel system which is located in the intake end of the burn tube assembly; and FIG. 7 is a front end view of the guard and heat tube assembly.

DETAILED DESCRIPTION OF THE INVENTION

Figure 1:
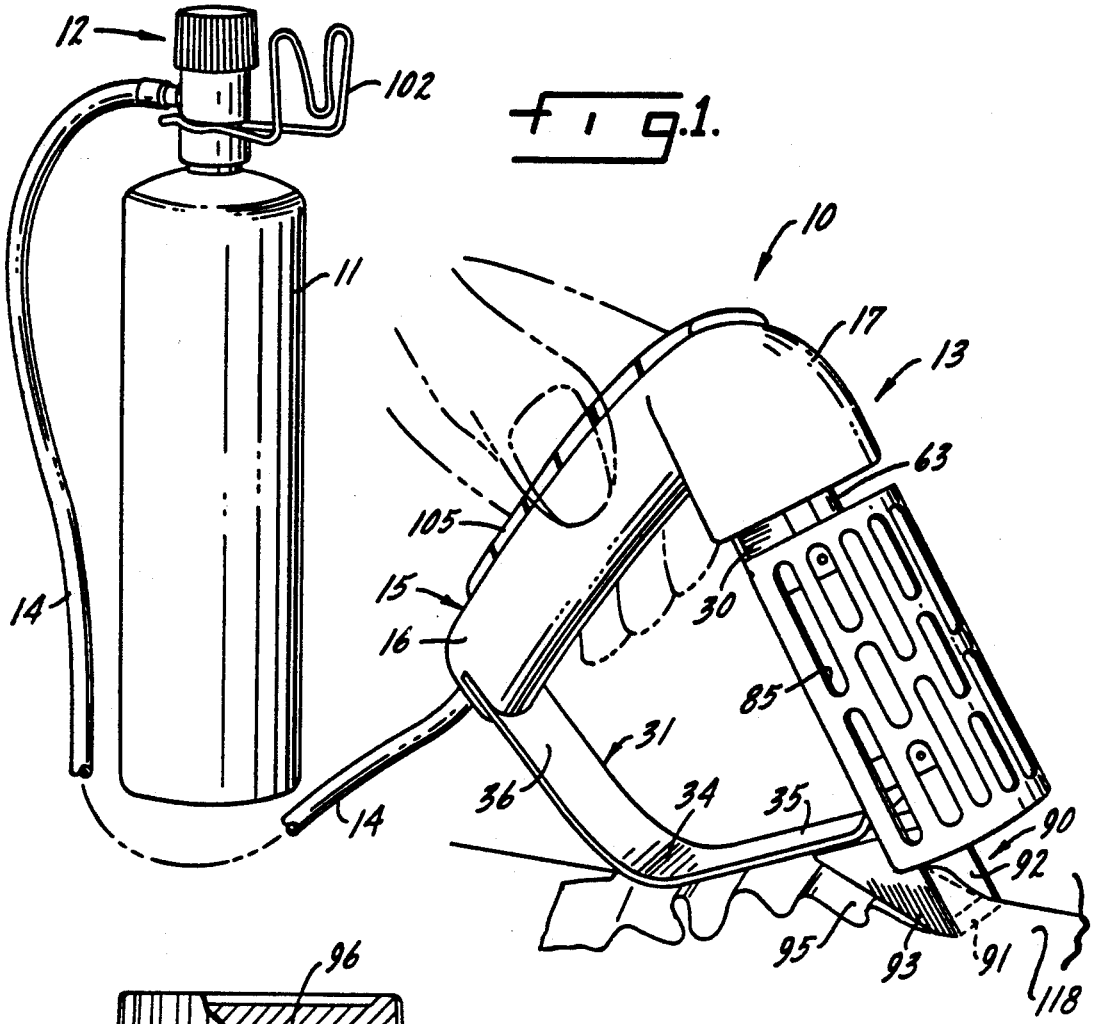
FIG. 1 is a perspective view of a coating stripping system which shows the stripping device being operated by one hand by an operator on a flat surface.

Like reference numerals will be used to refer to like parts from Figure to Figure in the drawing. Since a common use for the system is to strip paint, the invention will describe in conjunction with a paint stripping device; it may also be referred to simply as a paint stripper.

A paint stripping system which includes the paint stripping device of this invention and the method of stripping paint of this invention is illustrated generally at 10 in FIG. 1. The system includes a source of fuel 11 which may, for example, be a conventional bottle of suitable torch fuel, such as pressurized propane gas, a regulator assembly, indicated generally at 12, for regulating the rate of fuel flow to the paint stripping device, a paint stripping device, indicated generally at 13, and a hose 14 which connects the regulator assembly 12, and thereby the fuel source 11, to the paint stripping device 13.

The paint stripping device 13 includes a generally L-shaped housing 15, the right half of which is indicated at 16, see FIGS. 1 and 3, and the left half at 17, see FIG. 1. It will be understood that the complimentarily contoured left half is assembled to the right half by a typical snap connection provided by the offset edges, and the two halves thereafter secured to one another by, in this instance, five plastic self-tapping screws in screw receptacles 18, 19, 20, 21 and 22. Reinforcement struts are present where needed, such as at 23. The front end of the housing 15 is open as at 24 and an access opening for the hose assembly is indicated at 25 at the partially enclosed rear end 26. An elongated receptacle having parallel side walls 27, 28 and end wall 29, mates with a similarly contoured and oriented receptacle in the left half of the housing to form a pocket into which the top end 30 of a frame, indicated generally at 31, is received. The bottom rear end of the right half 16 of the housing 15 is apertured as at 32 to receive the other end of frame 31.

Frame 31 is, in this instance, formed from a single wide strip of metal, the top end 30 of which is received and anchored in the frame receptacle formed in the short leg of the L-shaped housing and the rear end of which is received in the aperture 32 formed at the bottom rear end of the housing. The frame includes a guard assembly mounting section 33, a working surface or bight portion 34 which, in this instance, is formed in a gentle curve, a blade mounting section 35 and a rear section 36, the terminal end of which is received in the housing aperture 32.

Figure 4:
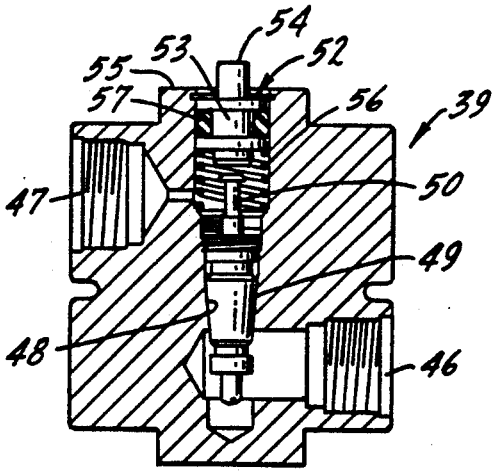
FIG. 4 is a vertical section to an enlarged scale through the fuel valve assembly of the stripping device.

A burn tube assembly is indicated generally at 3 in FIGS. 3 and 5, and a fuel valve assembly is indicated generally at 39 in FIGS. 3 and 4, the fuel valve assembly being located between and connecting the burn tube assembly 38 and the hose 14 which leads to fuel source 11. The fuel valve assembly 39 is fixed in position within the housing by means of a locating pin 40 and a pair of struts 41, 42 which are integral with the housing. The burn tube assembly 38 is fixed in position with respect to housing 13 by brackets 43, 44. The downstream end of hose 14 is received in outlet 46 in valve assembly 39, see FIG. 4. An outlet for the valve assembly 39 is indicated at 47. A fuel flow passage is indicated at 48 connecting inlet 46 to outlet 47. A tapered valve seat is indicated at 49 seated in the flow passage, the valve having a small internal passageway which is blocked and unblocked by a valve member, not shown, connected to a bottom end of valve stem 50. In the FIG. 4 position the valve member is shown in a closed position, the valve member being seated in a valve seat under the urging of an internal spring or other suitable biasing means. A valve actuator assembly is indicated generally at 52, the valve actuator assembly including a generally inverted, double Tee shaped actuator 53 whose stem 54 projects above the top surface 55 of the valve assembly 39. Stem 54 is biased to the illustrated FIG. 4 position by a spring 56 seated on a ledge in passageway 48. An O-ring seal is indicated at 57.

An orifice assembly which connects the valve assembly 39 to the burn tube assembly is indicated generally at 59 in FIGS. 3 and 6. The valve assembly includes a threaded inlet 60 which is threaded onto outlet 47 of the valve assembly 39. A central passage terminates in an outlet channel 61 whose exit is slightly downstream of air inlet opening 62, see FIG. 5, in the generally L-shaped burn tube 63 of the burn tube assembly 38 as best illustrated in FIG. 3.

Referring now principally to FIG. 5, preferably the tapered surface 64 of the downstream end of the orifice assembly is located just upstream of the air inlet opening 62, and hence upstream from the inlet end of a venturi 66 which is press-fitted within the burn tube 63 just downstream of the burn tube air inlets 62. A flame holder vane assembly is indicated at 68 very near the outlet 69 of the burn tube 63. An ignition wire 71 enters the burn tube 63 at an air inlet hole 62 and passes through a passage formed in the wall of venturi 66, and terminates in end 72 which is held centered within burn tube 63 by centering bracket 73 just upstream of the flame holder vane assembly 68.

Downstream end 69 of the burn tube assembly is located within and discharges into a head tube 75, see FIGS. 3 and 7, which is secured, as by tack welding at 76, 77, for example, to posts 78, 79, 80 which are, in turn, integral with in-turned flanges 82, 83 of the heat guard 84. The heat guard is preferably formed with a plurality of apertures 85 which aid in the dissipation of heat generated during operation. The heat guard 84, and thus the heat tube 75 is connected to the frame 31 by rivets 86, 87 which pass through the flanges 82, 83 of the heat guard 84.

A scraper blade assembly is indicated generally at 90. Scraper blade assembly 90 includes a blade 91 which is integrally formed with the bottom portions of generally triangularly shaped left and right side walls 92, 93, the upper edges of said side walls terminating in in-turned flanges, not shown, through which screws 94, see FIG. 3, connect the blade assembly to the blade mounting section 35 of frame 31. As can be best appreciated from FIGS. 1 and 3, particularly FIG. 1, the back end of the scraper blade assembly 90 is open to permit softened and lifted paint 95 to pass freely therethrough.

Figure 2:
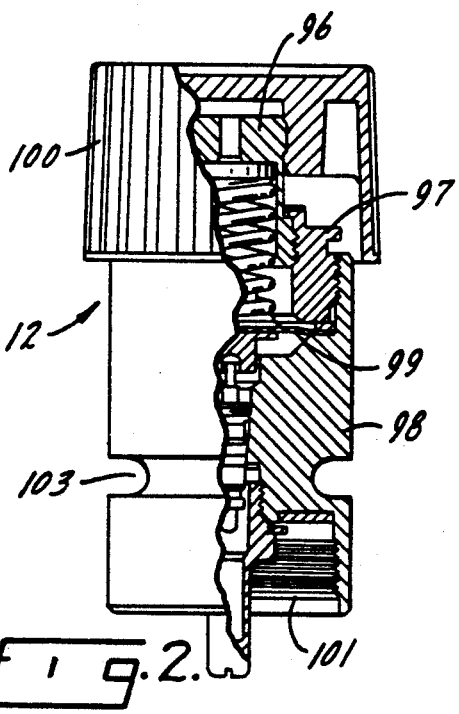
FIG. 2 is a view, to an enlarged scale and with parts broken away for clarity, of the regulator assembly which controls the flow rate of the fuel of the paint stripping system of FIG. 1.

The regulator assembly 12 of FIGS. 1 and 2 includes a bonnet 96 which is screw threaded onto a collar 97 which in turn is screw threaded to a housing 98. A spring loaded diaphragm is indicated at 99 and a knob at 100. The pressure within the regulator assembly is controlled by the relative positioning of bonnet 96 and collar 97. The inlet 101 of the regulator assembly is connected to an outlet nipple on the tank 11 and an outlet, not shown, on the down stream side of the regulator is connected to the inlet end of hose 14. A wire clip 102 which projects outwardly from a necked down indentation 103 on the regulator assembly enables the fuel tank 11, and the paint stripping device 13 as well, to be clipped to the belt surrounding the waist of the user.

The means for actuating the paint stripper 13 includes a lever 105 which projects through an aperture formed along the top junction line of the right and left housing halves 16 and 17 as best seen in FIG. 3. The underside of the upper end of the lever is pivotally connected to a pivot 106 and biased in an upward and outward direction by a leaf spring 107 which is formed integrally with the lever 105 and rests on the tip end of section 36 of the frame 31. The interior of the distal end 108 of the actuating lever has a socket 109 formed therein, the projecting end of which bears against the actuating stem 54. In the position illustrated in FIG. 3, the leaf spring 107 has biased the lever in a counter-clockwise direction until the upper surface of a lip 110 has butted against the under surface of the rear edge of the opening formed along the junction line between the halves 16 and 17 of the housing. In this position the actuator stem is in its FIG. 4 position and flow of gaseous fuel through valve assembly 39 is blocked.

An ignitor system for initiating combustion of the fuel-air mixture which is formed in the down stream end portion of the burn tube assembly 39 is indicated generally at 112 in FIG. 3. The system includes an ignitor 113 having a start button 114 which projects out of the top of housing 15. A first ignitor lead wire is indicated at 115, its distal end terminating in boss 116 where it contacts the proximate end of a second ignitor wire 71. An ignitor button which projects above the rounded surface of housing 15 is indicated at 117. The ignitor button projects through a second opening formed along the junction linè between housing halves 16 and 17 and may be spring biased, if desired, to the FIG. 3 position. It will be understood that the ends of the ignitor button 117 terminate in flanges or lip portions whose upper surfaces butt against the lower surface of the edge portion of the housing surrounding the button opening in much the same fashion as did lip 110 of the fuel-air lever 105. The underside of ignitor button 117 is aligned with the top surface of the start button 114 from which it will be seen that depression of ignitor button 117 will initiate combustion of the fuel-air mixture down stream of the end 72 of ignitor wire 71.

The use and operation of the paint stripping system of this invention including the paint stripper device, is as follows:

An operator grips the paint stripping device 13 by handle 15 with one hand is indicated in FIG. 1. Assuming, for ease of illustration, that one or more thicknesses of coating, such as paint, must be stripped from coated surface 118, the operator places the paint stripper device on the coated surface with scraper blade 91 and the bight portion 34 of frame 31 resting on the coated surface. With the paint stripping device in this position the flame to be emitted from the down stream discharge end 69 of burn tube assembly 38 will be at the correct impingement angle for must effective heating, and consequent softening, of the coating 95 on coated surface 118. From experience this angle has been determined to be on the order of about 60° as measured by the included angle between the center line of the heat flow and the coated surface. Since the paint stripping device, in this position, is provided with a stable two point support, the need for the operator to physically and mentally manipulate and control the angle of the flame with respect to the coated surface is eliminated. From FIG. 1 it will be seen that the frame 31 and the scraper blade 91 are of substantial width, with each of said components making line contact with the underlying surface so that there is no lateral or transverse instability, as well as no longitudinal instability.

After positioning the paint stripping device on the working surface, or before if desired, the flame intensity is optimized using the regulator assembly 12. It will be understood that as fuel gas exits orifice outlet 61 and enters venturi 66 it will draw air into contact with it through air inlet holes 62 due to the venturi effect; i.e., the lower pressure which exists in the throat of the venturi due to the higher rate of speed of the gas. Gas flow is initiated by the operator depressing lever 105 on the top of handle 15, the movement of the lever about pivot 106 causing the lever socket 109 to depress actuating stem 54 of the valve assembly 39, thereby actuating the valve member, not shown, in valve assembly 39 and permitting gas fuel under pressure to pass from inlet 46 to outlet 47, and into the inlet end of burn tube assembly 38. Once the gas is flowing and after it has mixed with air, ignitor button 117 is depressed, thereby actuating ignitor 113. Combustion of the gas-air mixture is thus initiated just down stream of end 72 of ignitor wire 71, and the flame holder vane assembly. The heat from the resulting flame will be directed against the coated surface 118 at the proper impingement angle, and at the proper distance from the coated surface since, by proper adjustment of the regulator assembly 12, the tip of the heat relative to the coated surface can be precisely established. Since the angle of impingement of the flame on the coated surface is constant, a simple adjustment of the regulator assembly followed by lock in at the optimum position will eliminate any need for the operator to be aware of and exercise control over flame intensity.

Since the scraper blade 91 is rigidly secured to frame 31, and the scraper blade and bight portion 34 of frame 31 provide the only points of support of the paint stripping device on the working surface 118, the angle of attack of the scraper blade 91 against the coating 95 is fixed at the optimum angle. Preferably the included optimum angle between the scraper blade and the working surface 118 is on the order of about 32°. Since the scraper blade assembly 90 has an open rear, the layer of coating, such as paint, after being softened by the flame and lifted by the attack of the scraper blade against it, will, due to its structural integrity, though flexible, slide up and over the blade and out one side, usually in a continuous ribbon, depending, of course, on the continuity or discontinuity of the coating on the surface to be stripped. As a result, the operator need not periodically stop the heating and scraping operations to remove stripped material which has clogged or piled up on the main stripping device at any location.

As a consequence, the operator need only concentrate on imparting an effective speed of movement to the stripping device. Indeed, the operator need not concentrate on applying an absolutely steady pressure so as to generate an absolutely uniform rate of speed; the operator can decrease the speed to some extent, depending on the operator's muscle control and the access available. In essence, the operator need only take care not to exceed a rate of speed which is too fast for effective coating removal.

Thus, the possibility of inefficient operation or poor quality results have been practically eliminated, even with inexperienced operators, yet these results are obtained using only one hand.

Although a preferred embodiment of the invention has been illustrated and described, it will be apparent to those skilled in the art that modifications may be made within the spirit and scope of the invention. Accordingly, it is intended that the scope of the invention be limited not by the foregoing description but solely by the hereafter appended claims when interpreted in light of the relevant prior art.

We claim:

1. A stripping device for removing coatings such as paint from surfaces to which said coatings are adhered, said device including means for scraping a coating from its underlying surface, flame means for softening the coating to be removed prior to this removal by the scraping means, means for directing a flame generated by the flame means onto the coating to be removed at a location in advance of the scraping means whereby the scraping means is not heated by contact with the flame generated by the flame means, means for maintaining the flame means and the scraping means in the same relative position with respect to each other and with respect to the coating surface as the flame means and the scraping means are moved together across the coated surface, the flame means, the scraping means and the means for maintaining the flame means and the scraping means in the same relative position with respect to one another being mechanically connected to each other to form a unitary structure whereby the stripping device may be moved across the coated surface to be scraped by one hand of an operator, the scraping means providing one of two contact points between the unitary structure and the coated surface, the means for maintaining the flame means and the scraping means in the same relative position including a rigid frame member which provides a base structure for the scraping means and the flame means, handle means for grasping the stripping device, said handle means being secured to the frame member, means for regulating the flow of a supply of fuel gas to create a heating flame, means for controlling the flow of gas fuel between on and off conditions, and means for igniting the gas fuel, said controlling and igniting means being carried by the handle means and under the control of the operator's hand while said operator's one hand grasps the handle means and moves the stripping device over a coated surface to remove coating from said coating surface.

2. The stripping device of claim 1 further characterized in that the rigid frame member provides the second contact point between the unitary structure and the coated surface.

3. A one hand operated coating stripping device for removing coating such as paint from a coated surface to which said coating is adhered, said stripping device including a burn tube assembly which emits a coating softening flame, a scraper blade assembly for scraping coating which has been softened by impingement of the heat thereon, a handle within which the inlet end portion of the burn tube assembly is received, a control valve assembly carried by the handle whose inlet is adapted to be connected to a source of gas fuel and whose outlet is connected to the inlet portion of the burn tube assembly, a control valve lever mounted on the handle in a position to open and close the control valve assembly while the stripping device is grasped by the operator, a rigid frame member to which the scraper blade and the handle are secured in fixed relationship, the outlet end portion of the burn tube assembly being located to direct heat from a flame into impingement on a coated surface at a desired angle for softening the coating preparatory to removal, and ahead of the line of contact of the scraper blade with the coated surface a distance sufficient to maximize coating removal efficiency as the stripping device moves over a coated surface to be stripped, said rigid frame member having a portion dimensioned to make contact with the coated surface behind the contact of the scraper blade with the coated surface to thereby provide transverse stability to the stripping device, whereby the stripping device is movable across the coated surface by an operator using one hand to strip coating.

4. The one hand operated coating stripping device of claim 3 further characterized in that the portion of the rigid frame member in contact with the coated surface makes line contact therewith.

* * * * *